US010099895B2

(12) United States Patent
Miseur et al.

(10) Patent No.: US 10,099,895 B2
(45) Date of Patent: Oct. 16, 2018

(54) WIRE, ROPE, AND CABLE MANAGEMENT

(71) Applicant: SafeWorks, LLC, Tukwila, WA (US)

(72) Inventors: Dirk Miseur, Wolvertem (BE); Nicolas Van der Linden, Antwerpen (BE)

(73) Assignee: SafeWorks, LLC, Tukwila, WA (US)

( * ) Notice: Subject to any disclaimer, the term of this patent is extended or adjusted under 35 U.S.C. 154(b) by 66 days.

(21) Appl. No.: 15/195,968

(22) Filed: Jun. 28, 2016

(65) Prior Publication Data

US 2017/0369281 A1 Dec. 28, 2017

(51) Int. Cl.
*B66B 7/06* (2006.01)
*B66B 9/187* (2006.01)

(52) U.S. Cl.
CPC ..... *B66B 7/06* (2013.01); *B66B 7/064* (2013.01); *B66B 9/187* (2013.01)

(58) Field of Classification Search
CPC ..... B66B 7/06; B66B 7/064
See application file for complete search history.

(56) References Cited

U.S. PATENT DOCUMENTS 2,017,372 A * 10/1935 Morrison ..... B66B 7/06 187/413
3,662,862 A * 5/1972 Poller ..... B66B 7/06 15/220.4
3,666,051 A * 5/1972 Davis ..... B66B 7/06 187/239
3,885,773 A * 5/1975 Dunkelberger ..... B66F 9/205 187/413
3,991,856 A * 11/1976 Shigeta ..... B66B 7/06 174/42
4,079,816 A * 3/1978 Ohta ..... B66B 7/06 174/42
4,117,908 A * 10/1978 Nara ..... B66B 7/06 187/254
5,609,225 A * 3/1997 Lamb ..... B66B 7/027 187/406
6,364,062 B1 * 4/2002 Ericson ..... B66B 7/062 187/264
9,758,344 B2 * 9/2017 Fauconnet ..... B66B 7/06
2010/0065381 A1 * 3/2010 Roberts ..... B66B 7/06 187/401
2014/0353091 A1 * 12/2014 Fauconnet ..... B66B 7/06 187/413

(Continued)

FOREIGN PATENT DOCUMENTS

EP 2923988 A1 9/2015
JP H01-299182 A 12/1989

(Continued)

OTHER PUBLICATIONS

International Patent Application No. PCT/US2017/039664; Int'l Search Report and the Written Opinion; dated Sep. 15, 2017; 16 pages.

*Primary Examiner* — Michael A Riegelman
(74) *Attorney, Agent, or Firm* — Baker & Hostetler LLP

(57) ABSTRACT

An elevator cable management system is described to provide constraints on cable movements at a point between the top and bottom of an elevator track. The system may include a moving retainer bar with a cradle on top of an elevator car, and a fixed retainer bar that retains cables when the elevator car is above the fixed retainer bar.

20 Claims, 8 Drawing Sheets

(56) References Cited

U.S. PATENT DOCUMENTS

| | | | | |
|---|---|---|---|---|
| 2016/0159612 | A1* | 6/2016 | Watanabe | B66B 7/064<br>187/413 |
| 2016/0207738 | A1* | 7/2016 | Altenburger | B66B 7/064 |
| 2017/0113901 | A1* | 4/2017 | Legua | B66B 9/00 |

FOREIGN PATENT DOCUMENTS

| | | | |
|---|---|---|---|
| JP | H02-255484 | A | 10/1990 |
| JP | 2009-143637 | A | 7/2009 |
| JP | 2014-169145 | A | 9/2014 |

* cited by examiner

WIRE, ROPE, AND CABLE MANAGEMENT

TECHNICAL FIELD

This disclosure relates to the fields of cable management and elevators.

BACKGROUND

Elevators move people and objects vertically along a track, for example between floors or platforms of a building or other structure. Traction elevators are suspended and moved by traction cables driven by a motor. The traction cables may, for example, be steel ropes which are pulled over a grooved pulley system called a sheave or may be flat belts made of steel or polyethylene. Hydraulic elevators are suspended and moved by a piston that is moved through a hydraulic cylinder by means of a pump. One or more guide rails may define the track that an elevator car moves along between the upper terminus and the lower terminus of the track.

SUMMARY

Illustrative examples of the present disclosure include, without limitation, methods, structures, and systems. In one example, an elevator cable management system is configured to provide constraints on cable movements at a point between the top and bottom of an elevator track. The elevator cable management system may include a moving retainer bar with a cradle on top of an elevator car, and a fixed retainer bar that retains cables when the elevator car is above the fixed retainer bar Other features of the methods, structures, and systems are described below. The features, functions, and advantages can be achieved independently in various examples or may be combined in yet other examples, further details of which can be seen with reference to the following description and drawings.

BRIEF DESCRIPTION OF THE DRAWINGS

A more detailed understanding may be had from the following description, given by way of example in conjunction with the accompanying drawings wherein.

DETAILED DESCRIPTION

A cable management system helps to manage the long runs of cables in an elevator shaft. In cases where an elevator shaft may move or bend, such as when the overall building or structure that the elevator is a part may sway or bend as a result of wind pressure on the side of a building, retaining the elevator cables in a safe position within the elevator shaft can be important to prevent damage to the cables or damage to any objects, including other cables, that a swaying cable might contact if not retained. An example application is a service elevator for a large wind turbine or tall construction crane.

Figure 1:
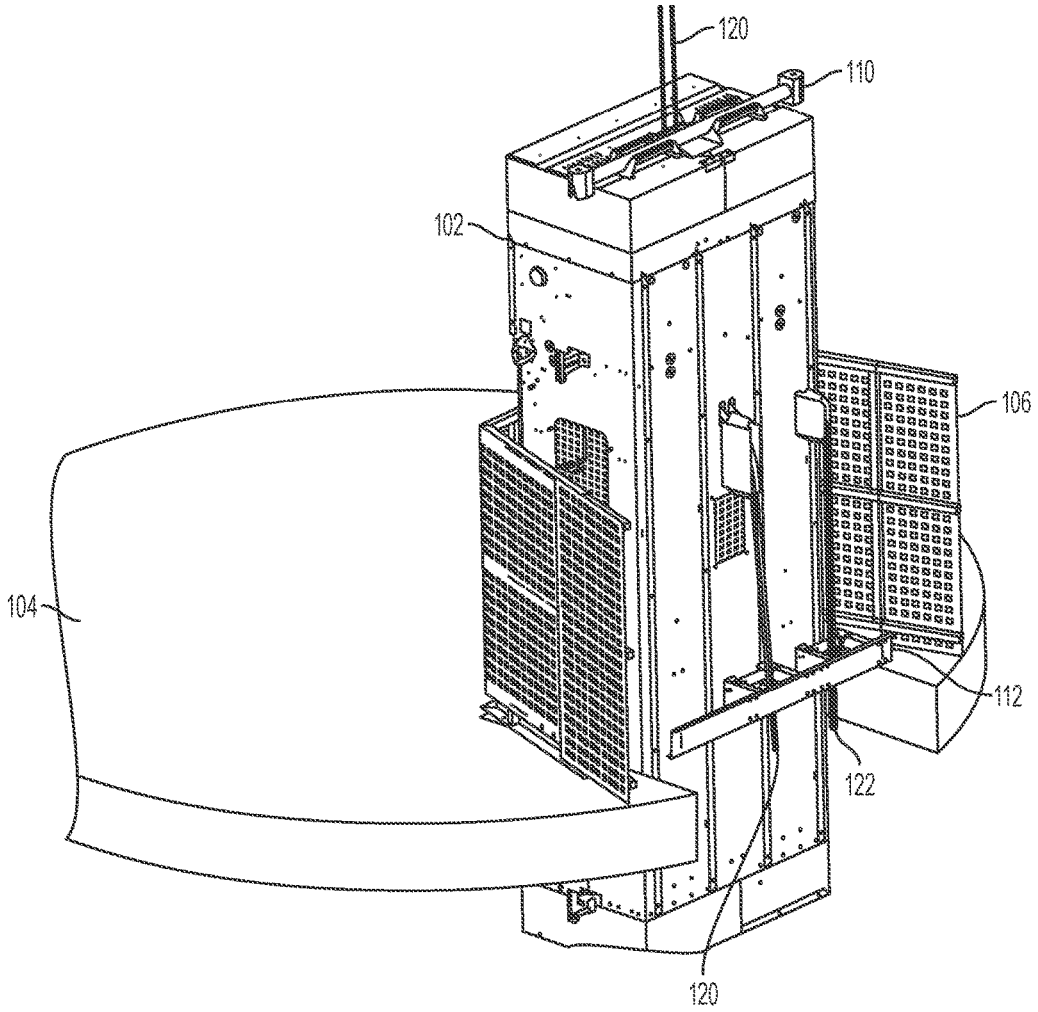
FIG. 1 is a perspective view of a portion of an elevator system.

FIG. 1 is a perspective view of a portion of an elevator system. An elevator car 102 or cab moves vertically along a track (not depicted) between stations or stops along the track where humans or other cargo may be added or removed to the car 102. Platform 104 is such a stop somewhere midway along the elevator track. Gate 106 may protect the elevator shaft and prevent injury or other accidents when the car 102 is not at the platform 104 or when the car 102 is moving near the platform 104. A cable management system may include a moving bar 110 and a fixed bar 112 to provide physical constraints cable movement. Cables 120 and 122 may move as the elevator car 102 moves through the shaft and along the track. In the embodiment of FIG. 1, cables 120 are traction cables that provide the force to lift and move the car 102, while cable 122 is an electrical cable. Some cables, such as cables 120 may run the full length of the track, while other cables, such as cables 122 may run from one end of the track to the car 102 and terminate in the car 102.

A cable management system can manage any number and type of cables. Traction cables 120 are often made of steel ropes, but other types of cable materials are possible. In elevators where traction cables are not used, such as where traction belts are used or in a hydraulic elevator, a cable management system may be useful for constraining other types of cables such as an electrical or communications cable. A cable management system can provide useful constraints on many types of cables, such as wires, ropes, chains, or any type of flexible tension element.

The electrical cable 122 may, for example, provide electrical power to the car 102, such as for lighting the interior of the car 102, communications, such as an emergency telephone, and control, such as to remotely call the elevator to a particular floor or stop. The various functions of the electrical cable 122 can be combined into a single cable, for example with multiple electrical conductors running along the length of the cable within an insulating outer layer, or the various functions may be split into separate cables, some or all of which may be managed by a cable management system. Other types of cables, such as optical cables for communications, can also be managed by a cable management system. As depicted, electrical cable 122 runs from somewhere near the bottom of the track up to the car 102, such upper termination point of electrical cable 122 moves along with the car 102. Other arrangements are possible, including running the cables from a midpoint or the top of the track to the car 102.

Figure 2:
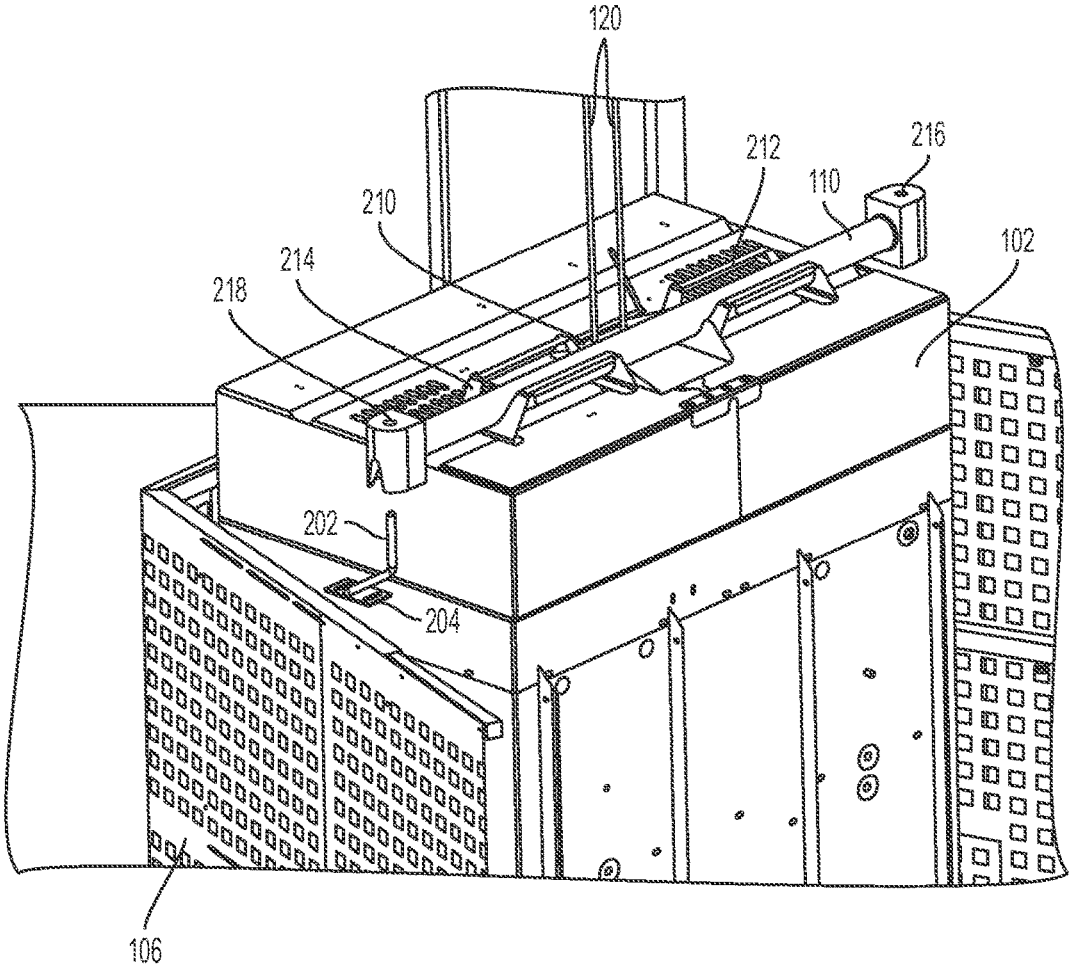
FIG. 2 is a perspective view of a movable cable constraint bar in its cradle when the cradle is above the threshold point.

Moving bar 110 moves with the elevator car 102 when the car 102 is above a threshold point somewhere midway along the elevator track, and moving bar 110 remains fixed at the threshold point when the elevator car is below the threshold point. FIG. 2 is a perspective view of a movable cable constraint bar 110 in its cradle on top of the car 102 when the cradle is above the threshold point. When above the threshold point, the bar 110 moves with the car 102. The weight of the bar 110 may keep the bar 110 sitting in a cradle when above the threshold point.

The cradle may comprise the left cradle 214 and right cradle 212 which, in the embodiment of FIG. 2, are attached to the top of the car 102, though attachments to other parts of the car 102 are possible. The location on the car 102 of a cable retainer may depend on the type or purpose of the cables retained by the moving bar 110, for example if the cables are hoisting ropes that suspend the car 110, the cradle may be attached close to the center of car, while electrical or communication cables may be more flexibly located. Bar 210 may include an opening that serves as a retainer 210 to provide a physical constraint on the movement of cables inside the retainer 210. The opening or retainer may be a hoop or other shape that constrains the retained cables along a plane that is perpendicular to the elevator track. Pin attachment 204 may be fixed to a point along the track to hold pin 202 at the threshold point. Pinhole 218 in the bar 110 may be aligned with the fixed pin 202 as the car 102 moves along the track and approaches the threshold point.

The location of the threshold point for suspending the moving bar can be anywhere between ends of the elevator track. In some embodiments, such as that of FIGS. 2-4, the threshold point can be near or attached to an elevator stop or platform. Alternately, the threshold point may be located at or near the point along the elevator track where the structure holding the elevator is likely to bend the most, such as with a wind turbine tower, or the threshold point can simply be located near or at the halfway point along the track. Other locations for the threshold point are also feasible. Multiple thresholds points (not depicted) along a single elevator track can be used with multiple moving bars such that, for example, a first threshold point for a first moving bar may be located one-third of the way down from the top of the track, and a second threshold point may be located two-thirds of the way down from the top of the track.

Figure 3:
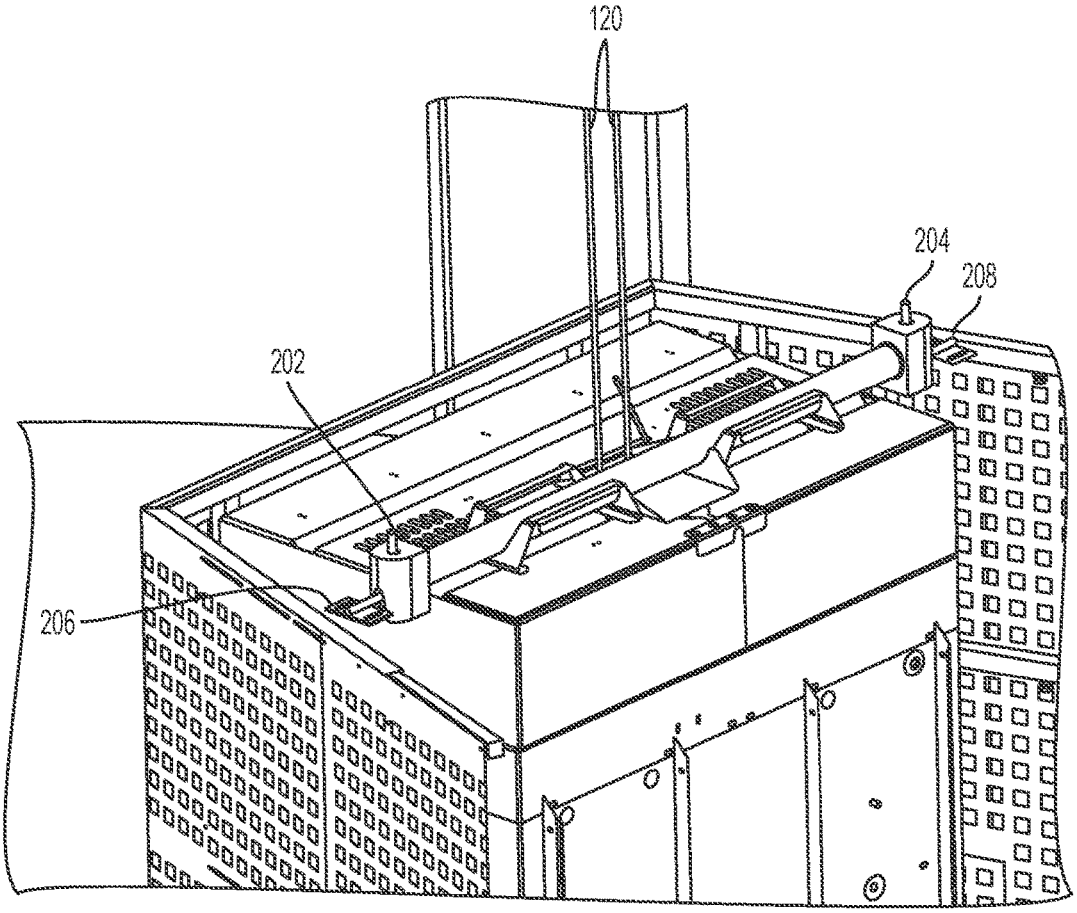
FIG. 3 is a perspective view of a movable cable constraint bar in its cradle when the cradle is at the constraint point.

FIG. 3 is a perspective view of a movable cable constraint bar in its cradle when the cradle is at the threshold point. Pin attachments 206 and 208 are fixed relative to the elevator track, and effectively define the threshold point. As the hoisting cables 120 lower the car 102, the pins 202 and 204 are inserted into the pinholes 216 and 218 at the threshold point. When the car 102 is exactly at the threshold point, the bar 110 remains in its cradles 212 and 214, and pin 202 and 204 are also in the pinholes 216 and 218. As the car 102 moves any lower along the track, the pins 202 and 204 hold the bar 110 fixed along the track while the car can continue to move lower.

Figure 4:
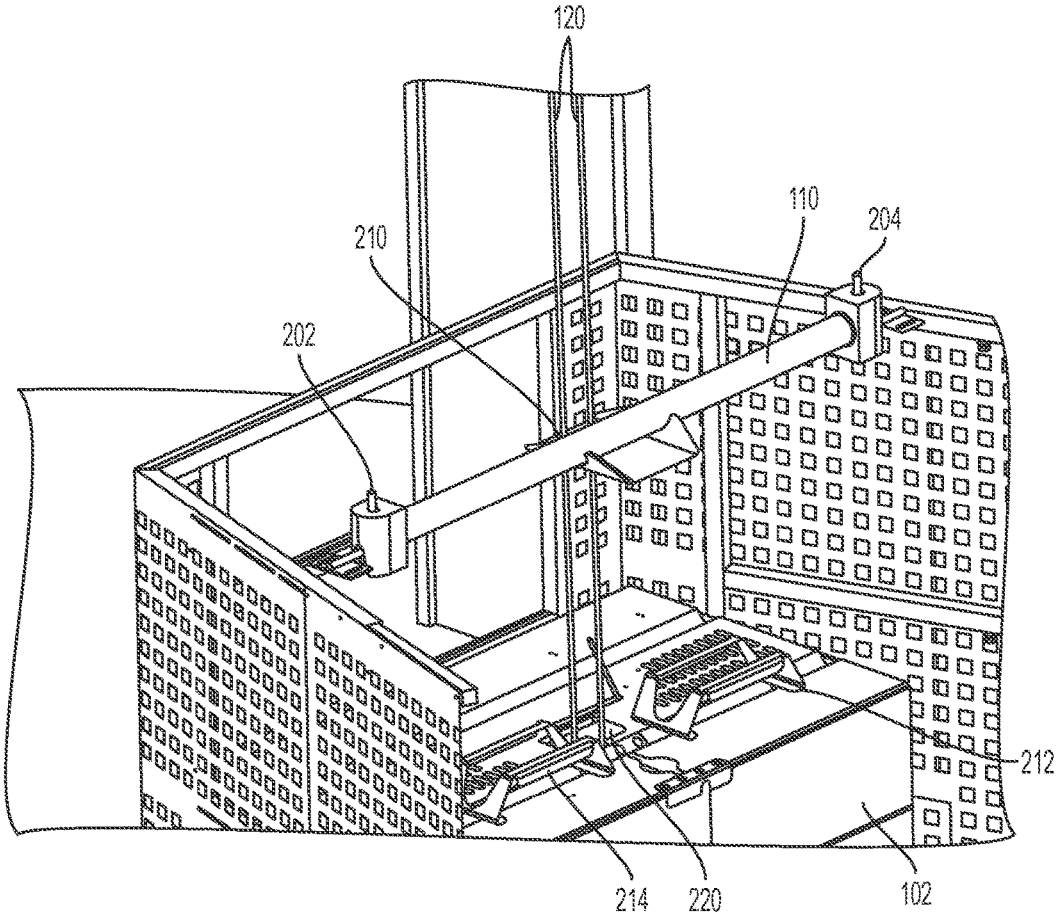
FIG. 4 is a perspective view of a movable cable constraint bar out of its cradle when the cradle is below the constraint point.

FIG. 4 is a perspective view of a movable cable constraint bar out of its cradle when the cradle is below the threshold point. Retainer 210 provides a constraint on the cables 120 when the car is below the threshold point as the movable bar 110 remains fixed on the pins 202 and 204. In addition to pins and pinholes, other mechanisms for holding bar 110 at the threshold point are possible.

Figure 5:
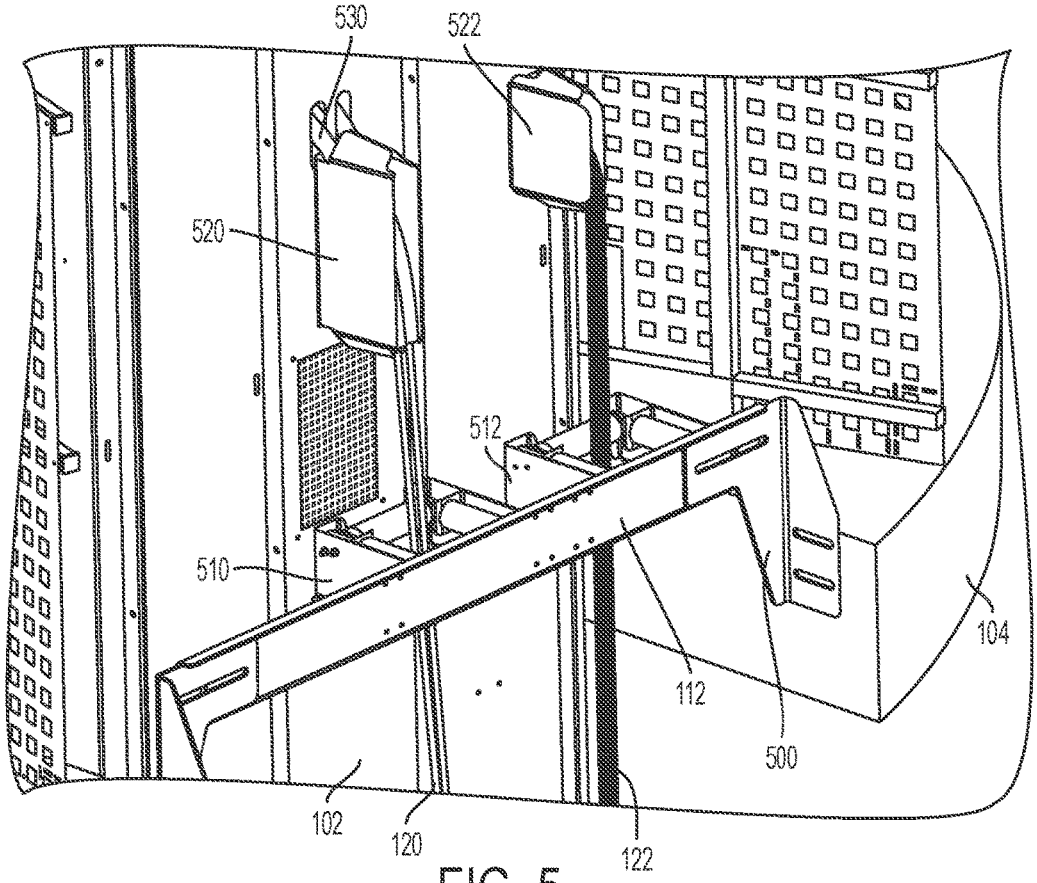
FIG. 5 is a perspective view of a fixed bar with two cable constraint channels while constraining cables.

In addition to, or instead of, the moving retainers attached to movable bar 110, retainers can be permanently fixed relative to the elevator track. FIG. 5 is a perspective view of a fixed bar with two cable constraint channels while constraining cables. Fixed bar 112 holds separate retainers 510 and 512. In the embodiment of FIG. 5, the left retainer 510 is positioned to retain hoisting cables 120 when the car 102 is above the fixed bar 112, and the right retainer 512 is positioned to retain the electrical cable 122 when the car 102 is above the fixed bar 112. Fixed bar 112 is supported by brace 500 which is fixed to platform 104. However, the fixed bar may be supported by any means that hold the bar fixed relative to the elevator track, for example by any other fixed structures inside an elevator shaft, such as the walls of the shaft. Hoisting cables 120 and electrical cable 122 emerge out of the back side of the elevator car 102. Electrical cable 122 terminates somewhere inside car 102, while hoisting cables 120 pass through a conduit 530 into car 102 and emerge out the top of car 102 as depicted in FIG. 1. Deflectors 520 and 522 aligned immediately above or below retainers 510 and 512, respectively, when car 102 is near the fixed bar 112, while the back side of the car 102 passes next to and near retainers 510 and 512. Deflectors 520 and 522 protect cables 120 and 122 as the car 102 passes by the retainers 510 and 512.

Figure 6:
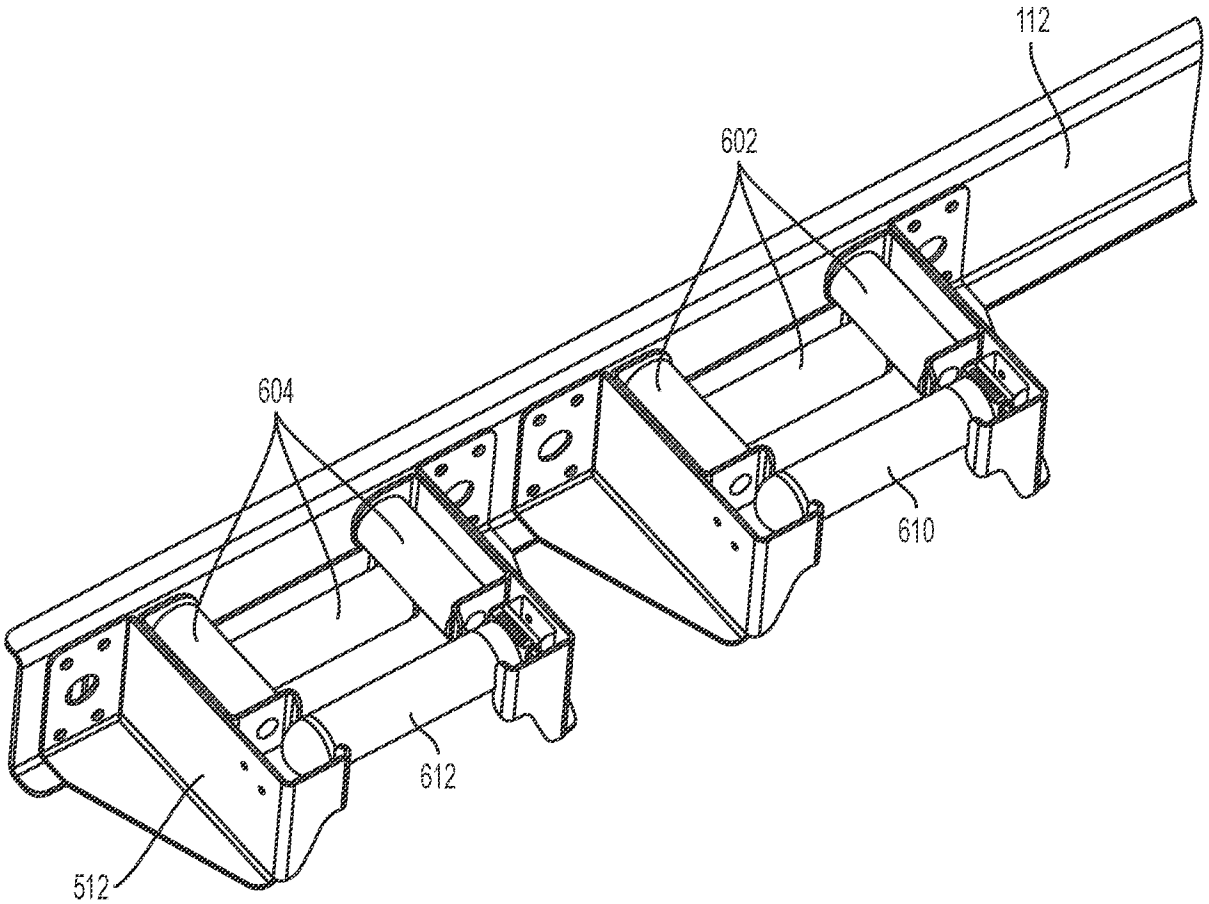
FIG. 6 is a reverse perspective view of a fixed bar with two empty cable constraint channels.

FIG. 6 is a reverse perspective view of a fixed bar with two empty cable constraint channels, with a closer view of the retainers 510 and 512. The retainers 510 and 512 are hoops comprising four rollers each. Fixed rollers 602 and 604 are fixed in relation to the fixed bar 112, while hinged rollers 610 and 612 are hinged with a spring configured to maintain the horizontal position of rollers 610 and 612 depicted in FIG. 6 whenever the deflectors 520 and 522 are not passing through the retainer as described below with respect to FIG. 7 and FIG. 8. The rollers form interior edges of the hoop retainers 510 and 512, and are the horizontal physical constraint that helps to manage the cables when the car 102 is above the fixed bar 112. In the embodiment of FIG. 6, there are 3 fixed rollers per retainer and one hinged roller per retainer, forming a square or rectangular hoop retainer. Other retainer shapes are feasible, such as a triangle with three straight edges, and curved edges are also possible. The edges of the hoop retainer may be configured to reduce friction as cables move vertically through the retainers 510 and 512. Rollers are one mechanism to reduce this friction, but other designs are possible.

Figure 7:
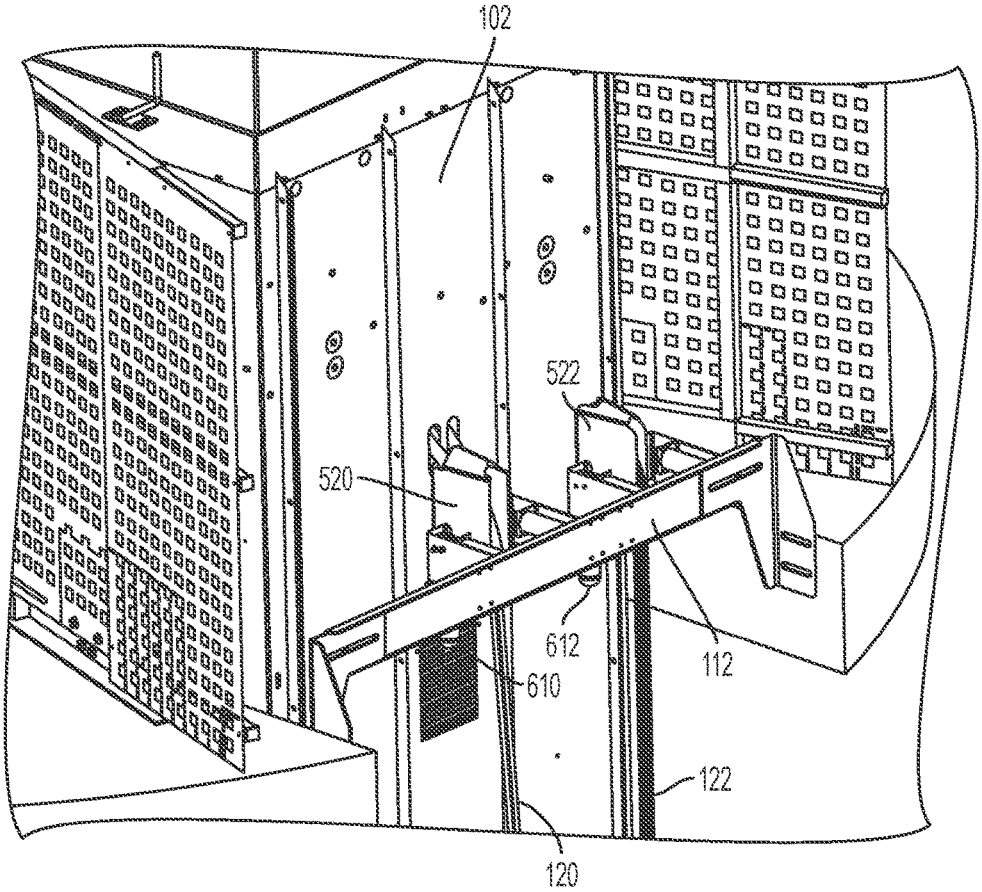
FIG. 7 is a perspective view of two cable constraint channels when open downward.

FIG. 7 is a perspective view of two cable constraint channels when open downward. Retainers 510 and 512 are cable constraint channels. As the elevator car 102 moves down, the deflectors 520 and 522 push the spring rollers 610 and 612, respectively, into a downward pointing position as depicted in FIG. 7, and the cables are removed from the retainers. From the car position of FIG. 5, when car 102 moves down to where the deflectors 520 and 522 meet the retainers 510 and 512, the bottom edge of deflectors 520 and 522 come into contact with the top side of spring rollers 610 and 612. As the car 102 moves down further, the deflectors 520 and 522 push the spring rollers 610 and 612 into a downward pointing position to allow the deflectors to pass through the retainers. Continuing further down, the car 102 passes the retainers 510 and 512, and the spring rollers 610 and 612 swing back into a horizontal pointing position without the cables in the retainers. The retainers 510 and 512 do not retain any cables when the deflectors 520 and 530 are below the bar 112.

Figure 8:
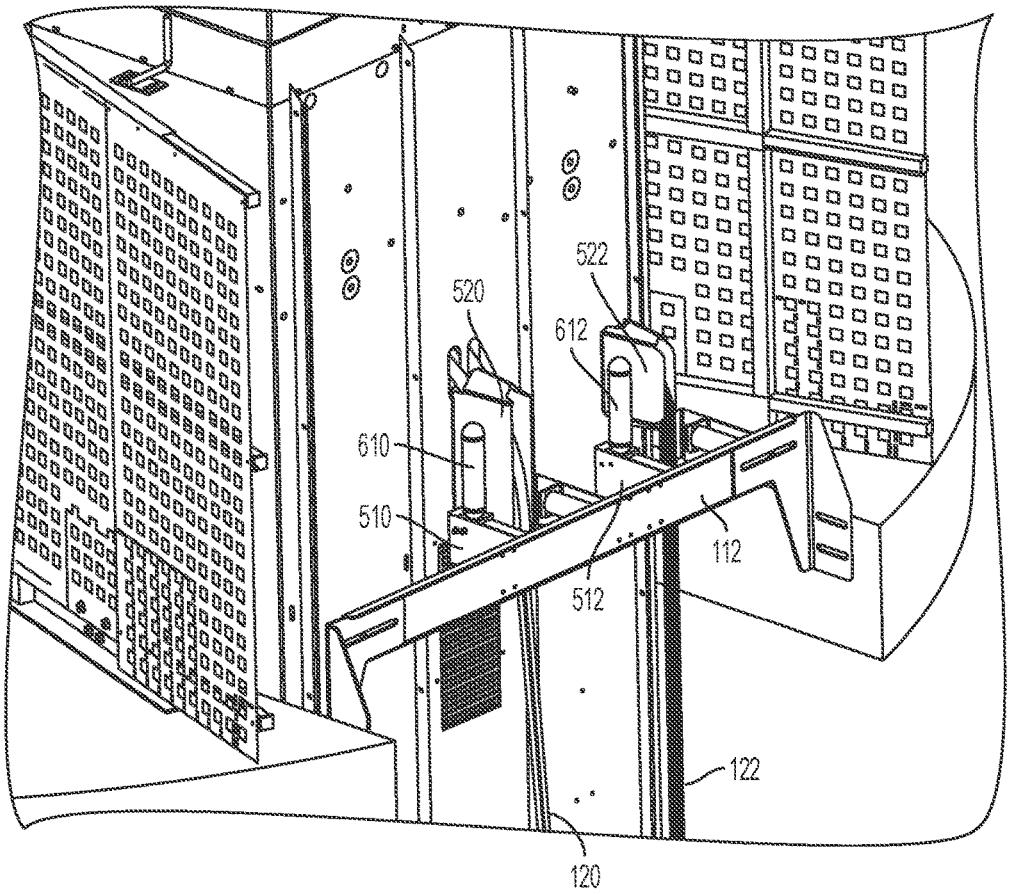
FIG. 8 is a perspective view of two cable constraint channels when open upward.

FIG. 8 is a perspective view of two cable constraint channels when open upward, as a result of the car 101 moving upward. As car 102 moves upward, the top of deflectors 520 and 522 contact the bottom of spring rollers 610 and 620, pushing the rollers up to an upward pointing position as depicted in FIG. 8. Moving in the upward direction, the cables are not in the retainers 510 and 512 when the car is below the bar 112. After the deflectors 520 and 522 pass through the retainers 510 and 512, the spring rollers 610 and 612 snap back to the horizontal pointing position depicted in FIG. 5 with the cables 120 and 122 inside the retainers. Alternates to the spring rollers 610 and 612 are possible. Any vertically deflectable edge may function similarly. A device or material will work that is capable of deflecting (or bending or moving) vertically as the deflectors 520 and 522 pass, while still providing a horizontal constraint on cables within the retainers will suffice.

In general, the various components and processes described above may be used independently of one another, or may be combined in different ways. All possible combinations and sub-combinations are intended to fall within the scope of this disclosure. The example systems and components described herein may be configured differently than described. For example, elements may be added to, removed from, or rearranged compared to the disclosed examples.

While different figures may represent alternate embodiments, identical element numbers used in different figures are intended to represent similar elements.

While certain examples or illustrative examples have been described, these examples have been presented by way of example only, and are not intended to limit the scope of the subject matter disclosed herein. Indeed, the novel methods and systems described herein may be embodied in a variety of other forms. The accompanying claims and their equivalents are intended to cover such forms or modifications as would fall within the scope and spirit of certain subject matter disclosed herein.

What is claimed:

1. An elevator cable management system comprising:

an elevator car configured to move, one or more first cables that extend from the elevator car;

one or more second cables that extend from the elevator car;

a first bar fixed at a location;

at least one first cable retainer configured to release the one or more first cables and the one or more second cables as the elevator car passes from above the first bar to below the first bar, and the at least one first cable retainer further configured to engage and retain the one or more first cables and the one or more second cables as the elevator car passes from below the first bar to above the first bar;

a second bar configured to move with the elevator car when the elevator car is above a threshold point, and wherein the second bar is configured to remain fixed at the threshold point when the elevator car is below the threshold point; and at least one second cable retainer fixed to the second bar and configured to retain the one or more first cables.

2. The elevator cable management system of claim 1, wherein the at least one first cable retainer and the at least one second cable retainer provide a constraint on horizontal movement of the one or more first cables and the one or more second cables.

3. The elevator cable management system of claim 2, wherein the constraint on horizontal movement comprises a hoop oriented perpendicular to the one or more first cables and the one or more second cables.

4. The elevator cable management system of claim 1, wherein the at least one first cable retainer comprises at least one fixed edge and one movable edge, and wherein the movable edge is configured to deflect as the elevator car passes the bar.

5. The elevator cable management system of claim 4, wherein the one or more first cables and the one or more second cables emerge from a vertical side of the elevator car;

wherein the elevator car comprises at least one deflector adjacent where the one or more first cables and the one or more second cables emerge from the elevator car; and wherein the at least one deflector is configured to cause the movable edge of the at least one first cable retainer to deflect.

6. The elevator cable management system of claim 1, wherein the one or more first cables are electrical and the one or more second cables are hoisting ropes.

7. The elevator cable management system of claim 1, further comprising:

at least one first support fixed at the threshold point configured to engage the second bar as the elevator car passes from above the threshold point to below the threshold point, and the at least one first support configured to hold the second bar when the elevator car is below the threshold point; and at least one second support fixed to the elevator car and configured to engage the second bar as the elevator car passes from below the threshold point to above the threshold point and configured to hold the second bar when the elevator car is above the threshold point.

8. An elevator cable management system comprising:

a bar fixed at a height along a vertical direction;

a first cable retainer configured to release one or more first cables as an elevator car passes from above the bar to below the bar and further configured to retain the one or more first cables as the elevator passes from below the bar to above the bar; and a second cable retainer configured to release one or more second cables as the elevator car passes from above the bar to below the bar and further configured to retain the one or more second cables as the elevator passes from below the bar to above the bar, wherein the first cable retainer is offset in a horizontal direction from the second cable retainer.

9. The elevator cable management system of claim 8, wherein the first cable retainer provides a constraint on horizontal movement of the one or more first cables, and the second cable retainer provides a constraint on horizontal movement of the one or more second cables.

10. The elevator cable management system of claim 9, wherein each of the constraints on horizontal movement comprises a respective hoop.

11. The elevator cable management system of claim 8, wherein each of the first and second cable retainers comprises at least one fixed edge and at least one movable edge, and wherein the at least one movable edge is configured to deflect as the elevator car passes the bar in the vertical direction.

12. The elevator cable management system of claim 8, wherein the one or more first cables are hoisting ropes and the one or more second cables are electrical cables.

13. The elevator cable management system of claim 8, wherein the second cable retainer is configured to release and retain the one or more second cables, which terminate in the elevator car.

14. An elevator cable management system comprising:

a first cable retainer defining a first opening configured to enclose at least one cable thereby restricting movement of the at least one cable in a horizontal direction; and a second cable retainer configured to move with an elevator car when the elevator car is above a threshold point along a vertical direction, and wherein the second cable retainer is configured to remain fixed at the threshold point when the elevator car is below the threshold point along the vertical direction, the second cable retainer defining a second opening configured to enclose the at least one cable thereby restricting movement of the at least one cable in the horizontal direction, wherein the first opening is offset from the second opening with respect to the horizontal direction, the first cable retainer is fixed at a height along the vertical direction, and the height is below the threshold point.

15. The elevator cable management system of claim 14, further comprising the elevator car, the elevator car including a third opening in a horizontal surface of the elevator car, the third opening: 1) aligned with the second opening with respect to the horizontal direction, and 2) configured to allow passage of the at least one cable through the third opening.

16. The elevator cable management system of claim 15, wherein the elevator car includes a fourth opening in a vertical surface of the elevator car, the fourth opening configured to allow passage of the at least one cable through the fourth opening.

17. The elevator cable management system of claim 14, wherein the at least one cable includes hoisting ropes.

18. The elevator cable management system of claim 14, further comprising the at least one cable extending through both the first opening and the second opening.

19. The elevator cable management system of claim 14, further comprising at least one first support fixed at the threshold point and configured to engage the second cable retainer as the elevator car passes from above the threshold point to below the threshold point and configured to hold the second cable retainer when the elevator car is below the threshold point.

20. The elevator cable management system of claim 14, further comprising at least one second support fixed to the elevator car and configured to engage the second cable retainer as the elevator car passes from below the threshold point to above the threshold point and configured to hold the second cable retainer when the elevator is above the threshold point.

* * * * *